US006540887B2

(12) United States Patent
de Nora

(10) Patent No.: US 6,540,887 B2
(45) Date of Patent: Apr. 1, 2003

(54) ALUMINUM ELECTROWINNING CELLS WITH OXYGEN-EVOLVING ANODES

(75) Inventor: Vittorio de Nora, Nassau (BS)

(73) Assignee: Moltech Invent SA, Luxembourg (LU)

( * ) Notice: Subject to any disclaimer, the term of this patent is extended or adjusted under 35 U.S.C. 154(b) by 58 days.

(21) Appl. No.: 09/897,711

(22) Filed: Jul. 2, 2001

(65) Prior Publication Data

US 2002/0027069 A1 Mar. 7, 2002

Related U.S. Application Data

(63) Continuation of application No. PCT/IB00/00027, filed on Jan. 10, 2000, which is a continuation-in-part of application No. PCT/IB99/00018, filed on Jan. 8, 1999.

(51) Int. Cl.[7] ..... B01D 59/40

(52) U.S. Cl. ..... 204/243.1; 204/247.3; 204/247.4; 204/247.5; 205/372; 205/375; 205/378; 205/380; 205/381

(58) Field of Search ..... 204/243.1, 247.3, 204/247.4, 247.5; 205/372, 375, 378, 380, 381

(56) References Cited

U.S. PATENT DOCUMENTS 4,022,679 A * 5/1977 Koziol et al. ..... 204/286
4,033,847 A * 7/1977 Baker ..... 204/286
4,557,818 A * 12/1985 Roos et al. ..... 204/288
5,279,715 A * 1/1994 La Camera et al. ..... 204/243.1
5,362,366 A * 11/1994 De Nora et al. ..... 204/245
5,589,044 A * 12/1996 Scannell et al. ..... 204/286
5,660,698 A * 8/1997 Scannell et al. ..... 204/283
5,725,744 A * 3/1998 De Nora et al. ..... 204/247.3
5,865,981 A * 2/1999 De Nora ..... 204/243.1
6,139,704 A * 10/2000 De Nora et al. ..... 204/247.3

* cited by examiner

*Primary Examiner*—Bruce F. Bell
(74) *Attorney, Agent, or Firm*—Jayadeep R. Deshmukh

(57) ABSTRACT

A cell for the electrowinning of aluminium comprises at least one non-carbon metal-based anode (10) having an electrically conductive metallic structure (12, 13, 15) which is suspended substantially parallel to a facing cathode (20, 21, 22). Such metallic structure (12, 13, 15) comprises a series of parallel horizontal anode members (15), each having an electrochemically active surface (16) on which during electrolysis oxygen is anodically evolved. The electrochemically active surfaces (16) are in a generally coplanar arrangement to form the active anode surface. The anode members are spaced apart from one another by intermember gaps forming flow-through openings (17) for the circulation of electrolyte (30) driven by the escape of anodically-evolved oxygen. The electrolyte (30) may circulate upwardly and/or downwardly in the flow-through openings (17) and possibly around the anode structure (12, 13, 15).

38 Claims, 8 Drawing Sheets

ALUMINUM ELECTROWINNING CELLS WITH OXYGEN-EVOLVING ANODES

This application is a continuation of PCT/IB00/00027 Jan. 10, 2000 which is a continuation-in-part PCT/IB99/00018 Jan. 8, 1999.

FIELD OF THE INVENTION

This invention relates to a cell for the electrowinning of aluminium from alumina dissolved in a fluoride-containing molten electrolyte such as cryolite, provided with non-carbon, metal-based, anodes designed for such aluminium electrowinning cells.

BACKGROUND ART

The technology for the production of aluminium by the electrolysis of alumina, dissolved in molten cryolite, at temperatures around 950° C. is more than one hundred years old.

This process conceived almost simultaneously by Hall and Héroult, has not evolved as many other electrochemical processes.

The anodes are still made of carbonaceous material and must be replaced every few weeks. During electrolysis the oxygen which should evolve on the anode surface combines with the carbon to form polluting $CO_2$ and small amounts of CO and fluorine-containing dangerous gases. The actual consumption of the anode is as much as 450 Kg/Ton of aluminium produced which is more than ⅓ higher than the theoretical amount of 333 Kg/Ton.

Using metal anodes in aluminium electrowinning cells would drastically improve the aluminium process by reducing pollution and the cost of aluminium production.

U.S. Pat. No. 4,999,097 (Sadoway) describes anodes for conventional aluminium electrowinning cells provided with an oxide coating containing at least one oxide of zirconium, hafnium, thorium and uranium. To prevent consumption of the anode, the bath is saturated with the materials that form the coating. However, these coatings are poorly conductive and have not been used.

U.S. Pat. No. 4,504,369 (Keller) discloses a method of producing aluminium in a conventional cell using massive metal oxide anodes having a central vertical through-opening for feeding anode constituents and alumina into the electrolyte, to slow dissolution of the anode.

U.S. Pat. No. 4,614,569 (Duruz/Derivaz/Debely/Adorian) describes metal anodes for aluminium electrowinning coated with a protective coating of cerium oxyfluoride, formed in-situ in the cell or pre-applied, this coating being maintained during electrolysis by the addition of small amounts of a cerium compound to the molten cryolite electrolyte. This made it possible to have a protection of the surface from the electrolyte attack and to a certain extent from gaseous oxygen but not from nascent monoatomic oxygen.

Several designs for oxygen-evolving anodes for aluminium electrowinning cells were proposed in the following documents. U.S. Pat. No. 4,681,671 (Duruz) discloses vertical anode plates or vertical blades operated in low temperature aluminium electrowinning cells. U.S. Pat. No. 5,310,476 (Sekhar/de Nora) discloses oxygen-evolving anodes consisting of roof-like assembled pairs of anode plates. U.S. Pat. No. 5,362,366 (de Nora/Sekhar) describes non-consumable anode shapes, such as roof-like assembled pairs of anode plates, as well as a downwardly curved flexible sheet or wire or bundle of wires. U.S. Pat. No. 5,368,702 (de Nora) discloses vertical tubular or conical oxygen-evolving anodes for multimonopolar aluminium cells. U.S. Pat. No. 5,683,559 (de Nora) describes an aluminium electrowinning cell with oxygen-evolving bent anode plates which are aligned in a roof-like configuration facing correspondingly shaped cathodes. U.S. Pat. No. 5,725,744 (de Nora/Duruz) discloses vertical oxygen-evolving anode plates, preferably porous or reticulated, in a multimonopolar cell arrangement for aluminium electrowinning cells operating at reduced temperature.

While the foregoing references indicate continued efforts to improve the operation of aluminium electrowinning cell operations by using oxygen-evolving anodes none of them has found any commercial acceptance yet.

OBJECTS OF THE INVENTION

It is an object of the invention to provide an aluminium electrowinning cell with one or more metal-based non-carbon anodes.

It is also an object of the invention to provide an aluminium electrowinning cell with one or more anodes which have a large surface area and a high electrochemical activity for the evolution of oxygen and which permit fast oxygen gas release and circulation of alumina rich electrolyte between the anodes and a facing cathode.

An object of the invention is to provide an aluminium electrowinning cell with one or more metal-based non-carbon anodes whose design permits an enhanced electrolyte circulation and which are easy and economic to manufacture.

Another object of the invention is to provide an aluminium electrowinning cell with one or more metal-based non-carbon anodes whose design permits an enhanced electrolyte circulation and which are made of a long lasting anode material leading to commercially acceptable produced aluminium and which can be shaped at will.

A further object of the invention is to provide an aluminium electrowinning cell with one or more metal-based non-carbon anodes whose design permits an enhanced electrolyte circulation and which are made of an anode material having a low solubility in the electrolyte.

An important object of the invention is to provide an aluminium electrowinning cell with one or more metal-based non-carbon anodes whose design permits an enhanced electrolyte circulation and which can be maintained dimensionally stable and do not excessively contaminate the product aluminium.

SUMMARY OF THE INVENTION

The invention provides a cell for the electrowinning of aluminium from alumina dissolved in a fluoride-containing molten electrolyte. The cell comprises at least one non-carbon metal-based anode having an electrically conductive metallic structure with an electrochemically active anode surface on which, during electrolysis, oxygen is anodically evolved, and which is suspended in the electrolyte substantially parallel to a facing cathode. Such metallic structure comprises a series of parallel horizontal anode members, each having an electrochemically active surface on which during electrolysis oxygen is anodically evolved, the electrochemically active surfaces being in a generally coplanar arrangement to form said active anode surface. The anode members are spaced apart to form longitudinal flow-through openings for the circulation of electrolyte driven by the fast escape of anodically evolved oxygen.

Depending on the cell configuration some or all of the flow-through openings may serve for the flow of alumina-rich electrolyte to an electrolysis zone between the anode(s) and the cathode and/or for the flow of alumina-depleted electrolyte away from the electrolysis zone. When the anode surface is horizontal or inclined these flows are ascending and descending. Part of the electrolyte circulation may also take place around the metallic anode structure.

A substantially uniform current distribution can be provided from a current feeder through conductive transverse metallic connectors to the anode members and their active surfaces.

As opposed to known oxygen-evolving anode designs for aluminium electrowinning cells, in an anode according to this invention the coplanar arrangement of the anode members provides an electrochemically active surface extending over an expanse which is much greater than the thickness of the anode members, thereby limiting the material cost of the anode.

The electrochemically active anode surface is usually substantially horizontal or inclined to the horizontal.

In special cases, the electrochemically active anode surface may be vertical or substantially vertical, the horizontal anode members being spaced apart one above the other, and arranged so the circulation of electrolyte takes place through the flow-through openings. For example, the anode members may be arranged like venetian blinds next to a vertical or substantially vertical cathode.

In one embodiment, two substantially vertical (or downwardly converging at a slight angle to the vertical) spaced apart adjacent anodes are arranged between a pair of substantially vertical cathodes, each anode and facing parallel cathode being spaced apart by an inter-electrode gap. The adjacent anodes are spaced apart by an electrolyte downflow gap in which alumina-rich electrolyte flows downwards until it circulates via the adjacent anodes' flow-through openings into the inter-electrode gaps. The alumina-rich electrolyte is electrolysed in the inter-electrode gaps thereby producing anodically evolved oxygen which drives alumina-depleted electrolyte up towards the surface of the electrolyte where the electrolyte is enriched with alumina, and induces the downward flow of alumina-rich electrolyte.

The anode members may be spaced-apart blades, bars, rods or wires. The bars, rods or wires may have a generally rectangular or circular cross-section, or have in cross-section an upper generally semi-circular part and a flat bottom. Alternatively, the bars, rods or wires may have a generally bell-shape or pear-shape cross-section.

Each blade, bar, rod or wire may be generally rectilinear or, alternatively, in a generally concentric arrangement, each blade, bar, rod or wire forming a loop to minimise edge effects of the current during use. For instance, each blade, bar, rod or wire can be generally circular, oval or polygonal, in particular rectangular or square, preferably with rounded corners.

Each anode member may be an assembly comprising an electrically conductive first or support member supporting or carrying at least one electrochemically active second member, the surface of the second member forming the electrochemical active surface. To avoid unnecessary mechanical stress in the assembly due to a different thermal expansion between the first and second members, the first member may support a plurality of spaced apart "short" second members.

The electrochemically active second member may be electrically and mechanically connected to the first support member by an intermediate connecting member such as a flange. Usually, the first member is directly or indirectly in contact with the electrochemically active second member along its whole length which minimises during cell operation the current path through the electrochemically active member. Such a design is particularly well suited for a second member made of an electrochemically active material which does not have a high electrical conductivity.

Such an anode member design is also suitable when the member is an entire body of electrochemically active material which is oxidation resistant and porous (such as bulk oxide) and which has an ionic conductivity permitting the oxidation of oxygen ions within the active material. When such an active material covers an oxidisable substrate, the substrate is possibly oxidised thereby expanding underneath the electrochemically active material subjecting it to mechanical damaging stress. By providing a support member which has a barrier to oxygen on its surface, such as chromium oxide, and which is electrically conductive but not necessarily electrochemically active, the support member is not oxidised by possible ionic oxygen reaching it. Ionic oxygen remains within the electrochemically active material and is eventually converted into monoatomic and biatomic oxygen therein.

The parallel anode members should be connected to one another for instance in a grid-like, net-like or mesh-like configuration of the anode members. To avoid edge effects of the current, the extremities of the anode members can be connected together, for example they can be arranged extending across a generally rectangular peripheral anode frame from one side to an opposite side of the frame.

Alternatively, the connection can be achieved by at least one connecting member. Possibly the anode members are connected by a plurality of transverse connecting members which are in turn connected together by one or more cross members. For concentric looped configurations, the transverse connecting members may be radial. In this case the radial connecting members extend radially from the middle of the parallel anode member arrangement and optionally are secured to or integral with an outer ring at the periphery of this arrangement.

Advantageously, the transverse connecting members are of variable section to ensure a substantially equal current density in the connecting members before and after each connection to an anode member. This also applies to the cross member when present.

Usually, each metallic anode comprises at least one vertical current feeder arranged to be connected to a positive bus bar. Such a current feeder is mechanically and electrically connected to one or more transverse connecting members or one or more cross members connecting a plurality of transverse connecting members, so that the current feeder carries electric current to the anode members through the transverse connecting member(s) and where present through the cross member(s). Where no transverse connecting member is present the vertical current feeder is directly connected to the anode members which are in a grid-like, net-like or mesh-like configuration.

The vertical current feeder, anode members, transverse connecting members and where present the cross members may be secured together for example by being cast as a unit. Assembly by welding or other mechanical connection means is also possible.

Usually, when the anode is not made of bulk electrochemically active material, the anode may have an oxygen-evolving coating, which may be an applied coating or a coating obtained by surface oxidation of a metallic anode substrate. Usually the coating is made of metal oxide such as iron oxide.

The anode(s) may slowly dissolve in the electrolyte. Alternatively, the operating conditions of the cell may be such as to maintain the or each anode dimensionally stable. For instance, a sufficient amount of anode constituents may be maintained in the electrolyte to keep the anode(s) substantially dimensionally stable by reducing or preventing dissolution thereof into the electrolyte.

The cell may comprise at least one aluminium-wettable cathode. The aluminium-wettable cathode may be in a drained configuration. Examples of drained cathode cells are described in U.S. Pat. No. 5,683,130 (de Nora), WO99/02764 and WO99/41429 (both in the name of de Nora/Duruz).

The cell may also comprise means to facilitate dissolution of alumina fed into the electrolyte, for instance by using electrolyte guiding members above the anode members as described in PCT/IB99/00017 (de Nora) inducing an up-flow and/or a down-flow of electrolyte through and possibly around the anode structure.

The electrolyte guide members may be secured together by being cast as a unit, welding or using other mechanical connecting means to form an assembly. This assembly can be connected to the vertical current feeder or secured to or placed on the foraminate anode structure.

The cell may also comprise means to thermally insulate the surface of the electrolyte to prevent the formation of an electrolyte crust on the electrolyte surface, such as an insulating cover above the electrolyte, as described in co-pending application WO99/02763 (de Nora/Sekhar).

A further aspect of the invention is a method of producing aluminium in a cell as described above. The method comprises passing an electric current through the anode members of the or each anode as electronic current and therefrom through the electrolyte to the cathode as ionic current, thereby producing aluminium on the cathode and oxygen on the electrochemically active anode surfaces whose escape induces an electrolyte circulation through the anode's flow through openings.

The invention also provides a non-carbon metal-based anode of a cell for the electrowinning of aluminium as described above. The anode has an electrically conductive metallic structure with an electrochemically active anode surface resistant to oxidation and fluoride-containing molten electrolyte, on which, during electrolysis, oxygen is anodically evolved, and which is suspended in the electrolyte substantially parallel to a facing cathode. Such metallic structure comprises a series of parallel horizontal anode members, each having an electrochemically active surface on which during electrolysis oxygen is anodically evolved. The electrochemically active surfaces are in a generally coplanar arrangement to form the active anode surface. The anode members are spaced apart to form longitudinal flow-through openings for the circulation of electrolyte driven by the fast escape of anodically evolved oxygen.

Anode Materials and Operation

Anodes of the present invention may consist of or preferably may be coated with an iron oxide-based material possibly obtained by oxidising the surface of an anode substrate which contains iron. Suitable anode materials are described in greater detail in co-pending application PCT/IB99/01360 (Duruz/de Nora/Crottaz), PCT/IB99/00015 (de Nora/Duruz), PCT/IB99/01361 (Duruz/de Nora/Crottaz), PCT/IB99/01362 (Crottaz/Duruz), PCT/IB99/01977 (de Nora/Duruz) and PCT/IB99/01976 (Duruz/de Nora).

In known processes, even the least soluble anode material releases excessive amounts of constituents into the bath, which leads to an excessive contamination of the product aluminium. For example, the concentration of nickel (a frequent component of proposed metal-based anodes) found in aluminium produced in small scale tests at conventional cell operating temperatures is typically comprised between 800 and 2000 ppm, i.e. 4 to 10 times the maximum acceptable level which is 200 ppm.

Iron oxides and in particular hematite ($Fe_2O_3$) have a higher solubility than nickel in molten electrolyte. However, in industrial production the contamination tolerance of the product aluminium by iron oxides is also much higher (up to 2000 ppm) than for other metal impurities.

Solubility is an intrinsic property of anode materials and cannot be changed otherwise than by modifying the electrolyte composition and/or the operative temperature of a cell.

Small scale tests utilising a $NiFe_2O_4$/Cu cermet anode and operating under steady conditions were carried out to establish the concentration of iron in molten electrolyte and in the product aluminium under different operating conditions.

In the case of iron oxide, it has been found that lowering the temperature of the electrolyte decreases considerably the solubility of iron species. This effect can surprisingly be exploited to produce a major impact on cell operation by limiting the contamination of the product aluminium by iron.

Thus, it has been found that when the operating temperature of the cell is reduced below the temperature of conventional cells (950–970° C.) an anode covered with an outer layer of iron oxide can be made dimensionally stable by maintaining a concentration of iron species and alumina in the molten electrolyte sufficient to reduce or suppress the dissolution of the iron-oxide layer, the concentration of iron species being low enough not to exceed the commercial acceptable level of iron in the product aluminium.

The presence of dissolved alumina in the electrolyte at the anode surface has a limiting effect on the dissolution of iron from the anode into the electrolyte, which reduces the concentration of iron species necessary to substantially stop dissolution of iron from the anode.

When the electrochemically active surface of the anode(s) is iron oxide-based, the electrolyte may comprise an amount of iron species and dissolved alumina preventing dissolution of the iron oxide-based electrochemically active surface. The amount of iron species and alumina dissolved in the electrolyte and preventing dissolution of the iron oxide-based electrochemically active surface of the or each anode should be such that the product aluminium is contaminated by no more than 2000 ppm iron, preferably by no more than 1000 ppm iron, and even more preferably by no more than 500 ppm iron.

To maintain the amount of anode constituents, in particular iron species, in the electrolyte which prevents at the operating temperature the dissolution of the or each anode if the alumina feed itself does not contain enough iron, anode constituents may be fed into the electrolyte intermittently, for instance periodically together with alumina, or continuously, for example by means of a sacrificial electrode. When the electrochemically active surface of the anode is iron oxide-based, iron species may be fed into the electrolyte in the form of iron metal and/or an iron compound such as iron oxide, iron fluoride, iron oxyfluoride and/or an iron-aluminium alloy.

To limit contamination of the product aluminium by cathodically-reduced anode constituents to a commercially acceptable level, the cell should be operated at a sufficiently low temperature so that the required concentration of dissolved alumina and anode constituents, in particular iron species, in the electrolyte is limited by the reduced solubility of iron species in the electrolyte at the operating temperature.

The cell may be operated with an operative temperature of the electrolyte below 910° C., usually from 730 to 870° C. The electrolyte may contain NaF and $AlF_3$ in a molar ratio $NaF/AlF_3$ required for the operating temperature of the cell comprised between 1.2 and 2.4. The amount of dissolved alumina contained in the electrolyte is usually below 8 weight %, preferably between 2 weight % and 6 weight %.

The inactive parts of anodes which during cell operation are exposed to molten electrolyte, in particular those parts near the surface of the electrolyte, may be protected with a zinc-based coating, in particular containing zinc oxide with or without alumina, or zinc aluminate. During cell operation, to substantially inhibit dissolution of such a surface, the concentration in the electrolyte of dissolved alumina should be maintained at or above 3 to 4 weight %.

BRIEF DESCRIPTION OF THE DRAWINGS

The invention will now be described with reference to the schematic drawings, wherein.

DETAILED DESCRIPTION

Figure 1A:
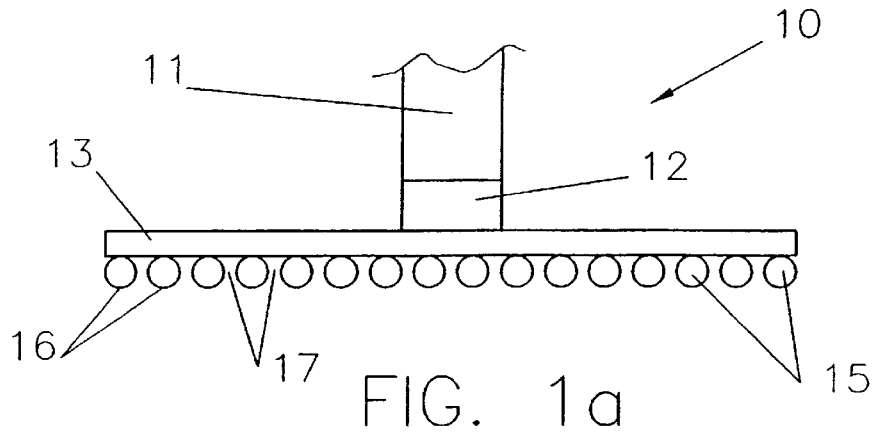
FIGS. 1*a* and 1*b* show respectively a side elevation and a plan view of an anode according to the invention.
Figure 1B:
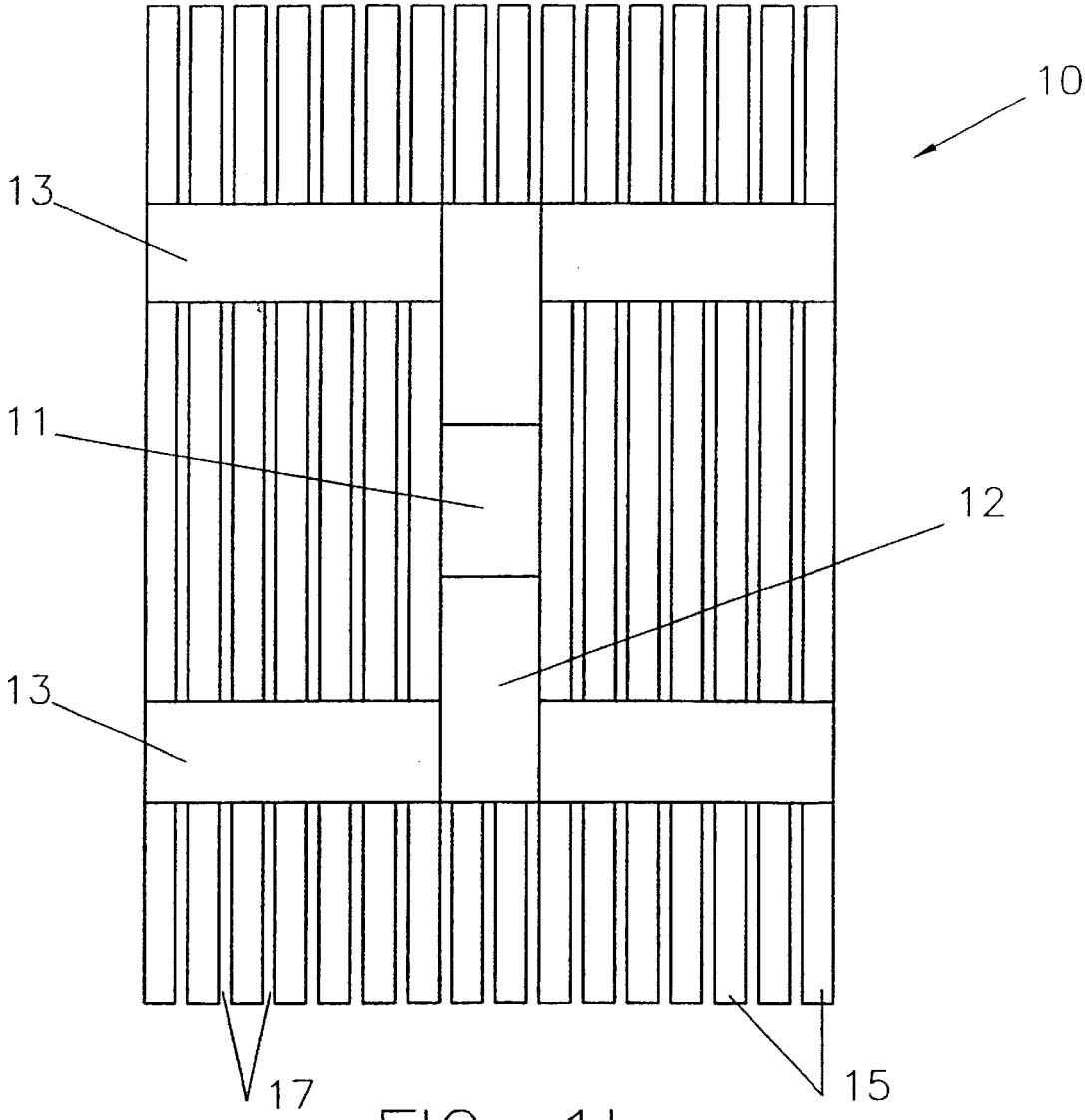

FIGS. 1*a* and 1*b* schematically show an anode 10 of a cell for the electrowinning of aluminium according to the invention.

The anode 10 comprises a vertical current feeder 11 for connecting the anode to a positive bus bar, a cross member 12 and a pair of transverse connecting members 13 for connecting a series of anode members 15.

The anode members 15 have an electrochemically active lower surface 16 where oxygen is anodically evolved during cell operation. The anode members 15 are in the form of parallel rods in a coplanar arrangement, laterally spaced apart from one another by inter-member gaps 17. The inter-member gaps 17 constitute flow-through openings for the circulation of electrolyte and the escape of anodically-evolved gas released at the electrochemically active surfaces 16.

The anode members 15 are transversally connected by the pair of transverse connecting members 13 which are in turn connected together by the cross member 12 on which the vertical current feeder 11 is mounted. The current feeder 11, the cross member 12, the transverse connecting members 13 and the anode members 15 are mechanically secured together by welding, rivets or other means.

As described above, the electrochemically active surface 16 of the anode members 15 can be iron-oxide based in particular as described in co-pending application PCT/IB99/01360 (Duruz/de Nora/Crottaz), PCT/IB99/00015 (de Nora/Duruz), PCT/IB99/01361 (Duruz/de Nora/Crottaz), PCT/IB99/01362 (Crottaz/Duruz), PCT/IB99/01977 (de Nora/Duruz) and PCT/IB99/01976 (Duruz/de Nora).

The cross-member 12 and the transverse connecting members 13 are so designed and positioned over the anode members 15 to provide a substantially even current distribution through the anode members 15 to their electrochemically active surfaces 16. The current feeder 11, the cross-member 12 and the transverse connecting members 13 do not need to be electrochemically active and their surface may passivate when exposed to electrolyte. However they should be electrically well conductive to avoid unnecessary voltage drops and should not substantially dissolve in electrolyte.

When the anode members 15 and the cross-members 12 are exposed to different thermal expansion, each anode member 15 as shown in FIG. 1 may be made into two (or more where appropriate) separate "short" anode members. The "short" anode members should be longitudinally spaced apart when the thermal expansion of the anode members 15 is greater than the thermal expansion of the cross-members 12.

Alternatively, it may be advantageous in some cases, in particular to enhance the uniformity of the current distribution, to have more than two transverse connecting members 13 and/or a plurality of cross-members 12.

Also, it is not necessary for the two transverse connecting members 13 to be perpendicular to the anode members 15 in a parallel configuration as shown in FIG. 1. The transverse connecting members 13 may be in an X configuration in which each connecting member 13 extends for example from one corner to the opposite corner of a rectangular or square anode structure, a vertical current feeder 11 being connected to the intersection of the connecting members 13.

Figure 2A:
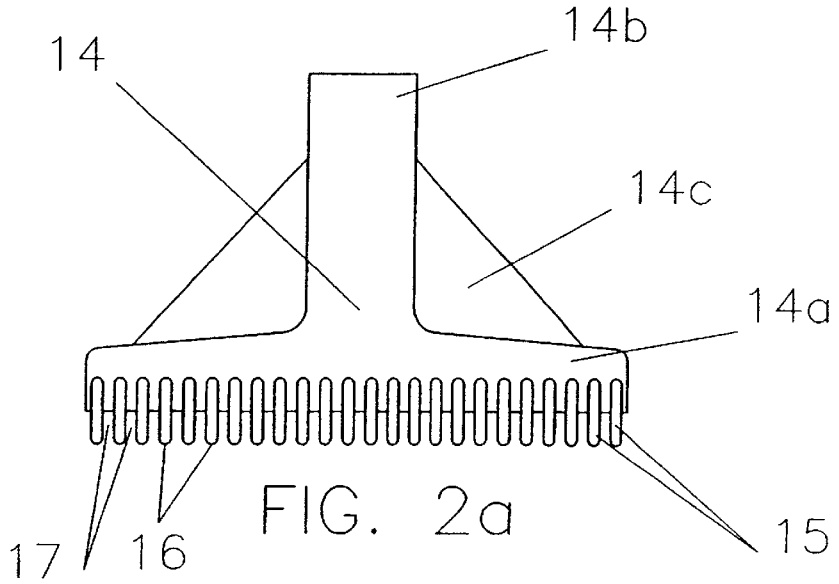
FIGS. 2*a* and 2*b* show respectively a side elevation and a plan view of another anode according to the invention.
Figure 2B:
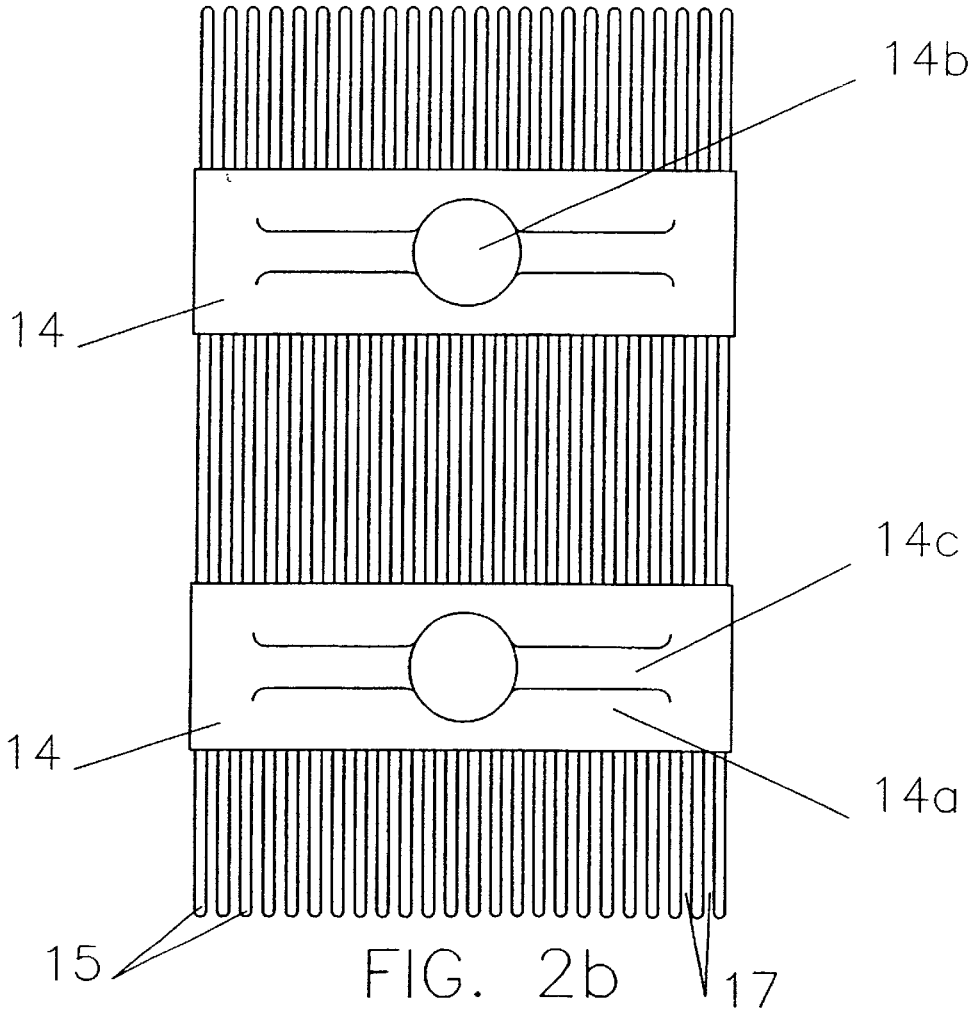

FIGS. 2*a* and 2*b* schematically show a variation of the anode 10 shown in FIGS. 1*a* and 1*b*.

Instead of having transverse connecting members 13, a cross-member 12 and a current feeder 11 for mechanically and electrically connecting the anode members 15 to a positive bus bar as illustrated in FIGS. 1*a* and 1*b*, the anode 10 shown in FIGS. 2*a* and 2*b* comprises a pair of cast or profiled support members 14 fulfilling the same function. Each cast support member 14 comprises a lower horizontally extending foot 14*a* for electrically and mechanically connecting the anode members 15, a stem 14*b* for connecting the anode 10 to a positive bus bar and a pair of lateral reinforcement flanges 14*c* between the horizontally extending foot 14*a* and stem 14*b*.

The anode members 15 may be secured by force-fitting or welding in the horizontal foot 14*a*. As an alternative, the shape of the anode members 15 and corresponding receiving slots in the foot 14*a* may be such as to allow only longitudinal movements of the anode members. For instance the anode members 15 and the foot 14*a* may be connected by dovetail joints.

FIGS. 3 to 6 show a series of anodes 10 according to the invention which are similar to the anode 10 shown in FIGS. 1*a* and 1*b*. However the cross-sections of the anode members 15 of the anodes 10 shown in FIGS. 3 to 6 differ to the circular cross-section of the anode members 10 shown in FIGS. 1*a* and 1*b*.

Figure 3:
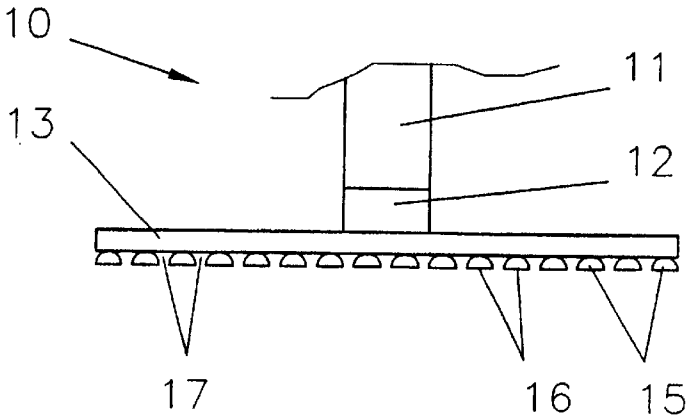
FIGS. 3, 4, 5 and 6 show side elevations of variations of the anode shown in FIGS. 1*a* and 1*b;*

The anode members 15 of the anode shown in FIG. 3 have in cross-section a generally semi-circular upper part and a flat bottom which constitutes the electrochemically active surface 16 of each anode member 15.

Figure 4:
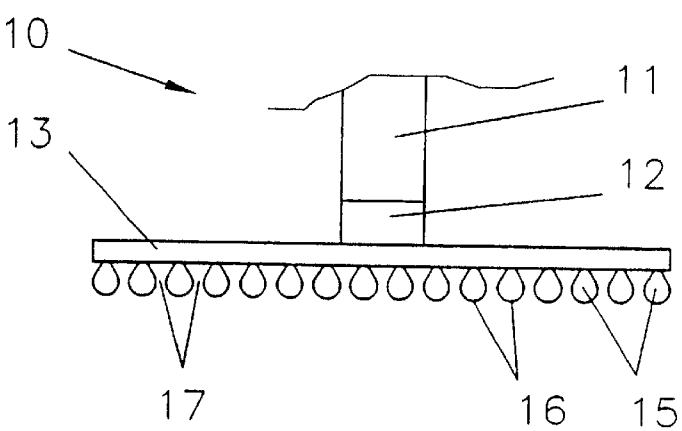

FIG. 4 illustrates anode members 15 in the form of rods which have a generally bell-shaped or pear-shaped cross-section. The electrochemically active surface 16 of the anode members 10 is located along the bottom of the bell-shape or pear-shape.

Figure 5:
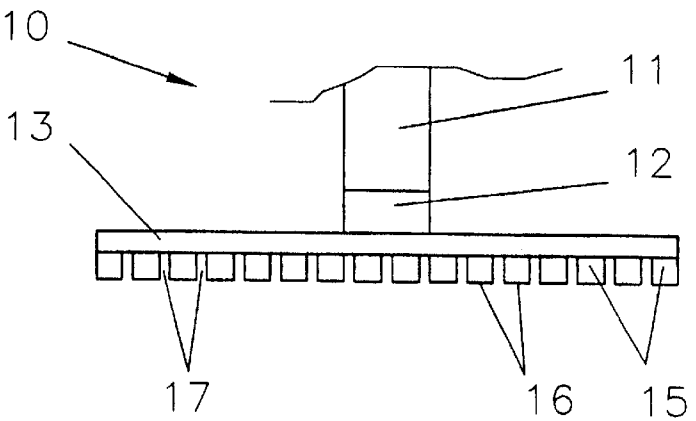

The anode members 15 shown in FIG. 5 are rods having a generally rectangular cross-section. The electrochemically active surface 16 is located along the bottom narrow side of the rod.

Figure 6:
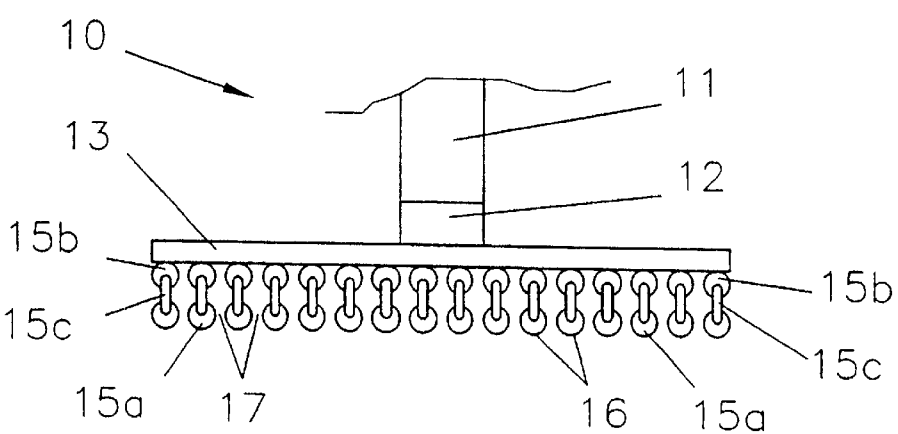
Figure 7:
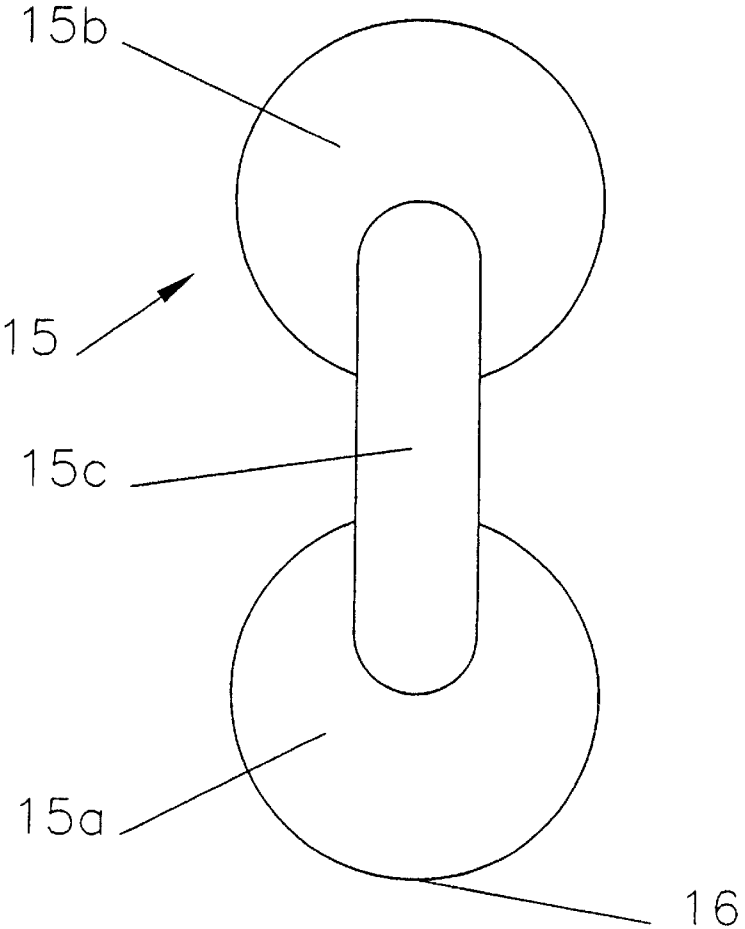

FIGS. 6 and 7 shows an anode 10 having assembled multi-part anode members 15 comprising a first member 15*b* supporting an electrochemically active second member 15*a*. The electrochemically active member 15*a* has an electrochemically active surface 16 and is connected along it whole length to the electrically well-conductive support member 15*b* by an intermediate connecting member 15*c* such as a flange. This anode member design is particularly well adapted for electrochemically active material which has a low electrical conductivity and/or which is ionically conductive as explained above.

FIG. 7 shows an enlarged view of the assembled anode member 15 of FIG. 6, comprising a generally cylindrical electrochemically active member 15*a* with an electrochemically active surface 16, a generally cylindrical electrically conductive support member 15*b* and an intermediate connecting member or flange 15*c* electrically and mechanically connecting the support member 15*b* to the electrochemically active member 15*a*. Alternatively, the connecting member 15*c* may be an extension of either the electrochemically active member 15*a* or the support member 15*b* as shown in FIG. 8.

The intermediate connecting member 15*c* shown in FIG. 7 may be connected to the electrochemically active member 15*a* and to the support member 15*b* by force-fitting or welding. However, these parts may be mechanically connected by providing a suitable geometry of the connecting members 15*c* and the corresponding receiving slots of the electrochemically active member 15*a* and the support member 15*b*, for instance with dovetail joints.

Figure 8:
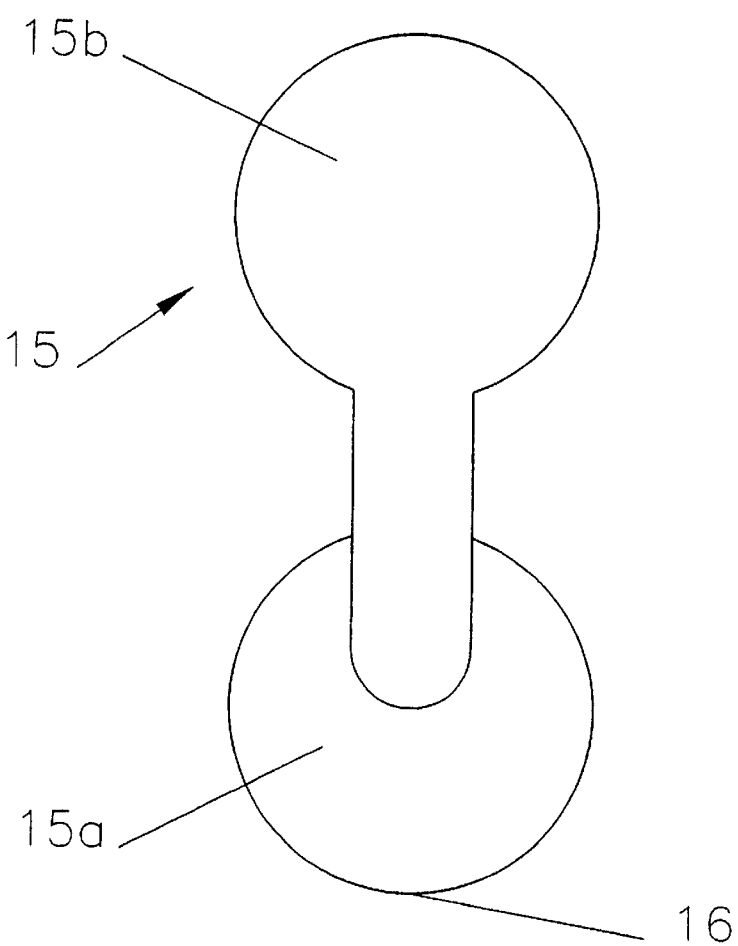
FIGS. 7 and 8 show cross-sections of multi-part anode members according to the invention.

The electrochemically active member 15*a* shown in FIGS. 7 and 8 may be iron oxide-based with or without additives, for instance an oxidised iron-nickel alloy, as disclosed in co-pending application PCT/IB99/01360 (Duruz/de Nora/Crottaz), PCT/IB99/00015 (de Nora/Duruz), PCT/IB99/01361 (Duruz/de Nora/Crottaz), PCT/IB99/01362 (Crottaz/Duruz), PCT/IB99/01977 (de Nora/Duruz) and PCT/IB99/01976 (Duruz/de Nora). Alternatively, the active member 15*a* may be made of a ferrite, such as nickel ferrite, or an oxidised alloy, in particular a cast alloy, of at least two metals selected from nickel, iron, copper and aluminiumn.

The support member 15*b* shown in FIGS. 7 and 8 and the connecting member 15*c* shown in FIG. 7 are preferably highly conductive and may comprise a metallic core, for instance of copper, covered with an electrolyte resistant material, for instance the materials mentioned above which are suitable for the electrochemically active member 15*a*.

As stated above, to avoid unnecessary mechanical stress in the assembly due to a different thermal expansion between the electrochemically active members 15*a* and the support members 15*b*, each support member 15*b* may support a plurality of longitudinally spaced apart "short" electrochemically active members 15*a*. The electrochemically active members 15*a* may be short cylinders or discs.

In a variation, the electrochemically active members 15*a* and/or the support member 15*b* may be horizontally extending prisms, for instance with a rectangular base.

Figure 9:
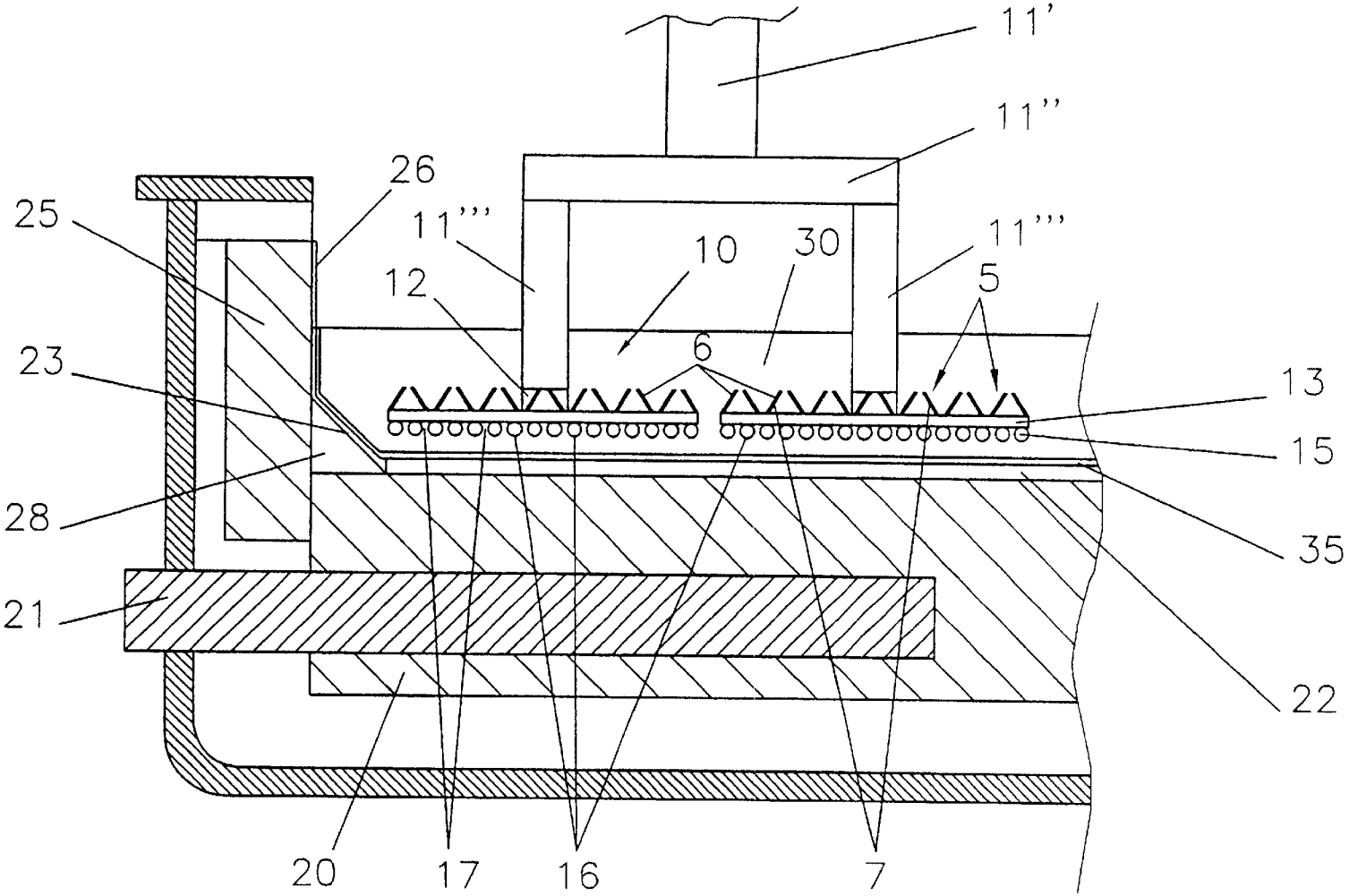
FIG. 9 shows an aluminium electrowinning cell operating with anodes according to the invention fitted with electrolyte guide members.

FIG. 9 shows an aluminium electrowinning cell according to the invention having a series of generally horizontal anodes 10 which are similar to those shown in FIGS. 1*a* and 1*b*, immersed in an electrolyte 30. The anodes 10 face a horizontal cathode cell bottom 20 connected to a negative busbar by current conductor bars 21. The cathode cell bottom 20 is made of conductive material such as graphite or other carbonaceous material coated with an aluminium-wettable refractory cathodic coating 22 on which aluminium 35 is produced and from which it drains or on which it forms a shallow pool, a deep pool or a stabilised pool. The molten aluminium 35 produced is spaced apart from the facing anodes 10 by an inter-electrode gap.

Pairs of anodes 10 are connected to a positive bus bar through a primary vertical current feeder 11' and a horizontal current distributor 11" connected at both of its ends to a foraminate anode 10 through a secondary vertical current distributor 11'''.

The secondary vertical current distributor 11''' is mounted on the anode structure 12, 13, 15, on a cross member 12 which is in turn connected to a pair of transverse connecting members 13 for connecting a series of anode members 15. The current feeders 1 the cross member 12, the transverse connecting members 13 and the anode members 15 are mechanically secured together by welding, rivets or other means.

The anode members 15 have an electrochemically active lower surface 16 on which during cell operation oxygen is anodically evolved. The anode members 15 are in the form of parallel rods in a foraminate coplanar arrangement, laterally spaced apart from one another by inter-member gaps 17. The inter-member gaps 17 constitute flow-through openings for the circulation of electrolyte and the escape of anodically-evolved gas from the electrochemically active surfaces 16.

The cross-member 12 and the transverse connecting members 13 provide a substantially even current distribution through the anode members 15 to their electrochemically active surfaces 16. The current feeder 11, the cross-member 12 and the transverse connecting members 13 do not need to be electrochemically active and their surface may passivate when exposed to electrolyte. However they should be electrically well conductive to avoid unnecessary voltage drops and should not substantially dissolve in the molten electrolyte.

The active surface 16 of the anode members 15 can be iron oxide-based. Suitable anode materials are described in co-pending application PCT/IB99/01360 (Duruz/de Nora/Crottaz), PCT/IB99/00015 (de Nora/Duruz), PCT/IB99/01361 Duruz/de Nora/Crottaz), PCT/IB99/01362 (Crottaz/

Duruz), PCT/IB99/01977 (de Nora/Duruz) and PCT/IB99/01976 (Duruz/de Nora).

The iron oxide surface may extend over all immersed parts 11''', 12, 13, 15 of the anode 10, in particular over the immersed part of the secondary vertical current distributor 11''' which is preferably covered with iron oxide at least up to 10 cm above the surface of the electrolyte 30.

The immersed but inactive parts of the anode 10 may be further coated with zinc oxide. However, when parts of the anode 10 are covered with zinc oxide, the concentration of dissolved alumina in the electrolyte 30 should be maintained above 4 weight % to prevent excessive dissolution of zinc oxide in the electrolyte 30.

The core of all anode components 11', 11'', 11''', 12, 13, 15 is preferably highly conductive and may be made of copper protected with successive layers of nickel, chromium, nickel, copper and optionally a further layer of nickel.

The anodes 10 are further fitted means for enhancing dissolution of fed alumina in the form of electrolyte guide members 5 formed of parallel spaced-apart inclined baffles 5 located above and adjacent to the foraminate anode structure 12,13,15. The baffles 5 provide upper downwardly converging surfaces 6 and lower upwardly converging surfaces 7 that deflect gaseous oxygen which is anodically produced below the electrochemically active surface 16 of the anode members 15 and which escapes between the inter-member gaps 17 through the foraminate anode structure 12,13,15. The oxygen released above the baffles 5 promotes dissolution of alumina fed into the electrolyte 30 above the downwardly converging surfaces 6.

A similar anode design was proposed in U.S. Pat. No. 4,263,107 (Pellegri) for improving electrolyte circulation in aqueous brine electrolysis. The anode was made of conventional anode materials for brine electrolysis, such as titanium coated with a platinum group metal oxide, having a foraminate active anode structure. Although, this anode design is well adapted for electrolyte circulation and gas release in brine electrolysis, it has never been proposed or suggested for use in aluminium electrowinning cells, which differ substantially to chlor-alkali cells, and in particular to improve the dissolution of fed alumina.

The aluminium-wettable cathodic coating 22 of the cell shown in FIG. 9 can advantageously be a slurry-applied refractory hard metal coating as disclosed in U.S. Pat. No. 5,651,874 (de Nora/Sekhar). Preferably, the aluminium-wettable cathodic coating 22 consists of a thick coating of refractory hard metal boride such as $TiB_2$, as disclosed in WO98/17842 (Sekhar/Duruz/Liu), which is particularly well suited to protect the cathode bottom of a drained cell as shown in FIG. 9.

The cell also comprises sidewalls 25 of carbonaceous or other material. The sidewalls 25 are coated/impregnated above the surface of the electrolyte 30 with a boron or a phosphate protective coating/impregnation 26 as described in U.S. Pat. No. 5,486,278 (Manganiello/Duruz/Bellò) and in U.S. Pat. No. 5,534,130 (Sekhar).

Below the surface of the electrolyte 30 the sidewalls 25 are coated with an aluminium-wettable coating 23, so that molten aluminium 35 driven by capillarity and magnetohydrodynamic forces covers and protects the sidewalls 25 from the electrolyte 35. The aluminium-wettable coating 23 extends from the aluminium-wettable cathodic coating 22 over the surface of connecting corner prisms 28 up the sidewalls 25 at least to the surface of the electrolyte 30. The aluminium-wettable side coating 23 may be advantageously made of an applied and dried and/or heat treated slurry of particulate $TiB_2$ in colloidal silica which is highly aluminium-wettable.

Alternatively, above and below the surface of the electrolyte 30, the sidewalls 25 may be covered with a zinc-based coating, such as a zinc-oxide coating optionally with alumina or a zinc aluminate coating. When a zinc-based coating is used to coat sidewalls 25 or anodes 10 as described above, the concentration of dissolved alumina in the molten electrolyte 30 should be maintained above 4 weight % to substantially prevent dissolution of such a coating.

During cell operation, alumina is fed to the electrolyte 30 all over the baffles 5 and the metallic anode structure 12,13,15. The fed alumina is dissolved and distributed from the bottom end of the converging surfaces 6 into the inter-electrode gap through the inter-member gaps 17 and around edges of the metallic anode structure 12,13,15, i.e. between neighbouring pairs of anodes 10 or between peripheral anodes 10 and sidewalls 25. By passing an electric current between anodes 10 and facing cathode cell bottom 20 oxygen is evolved on the electrochemically active anode surfaces 16 and aluminium is produced which is incorporated into the cathodic molten aluminium 35. The oxygen evolved from the active surfaces 16 escapes through the inter-member gaps 17 and is deflected by the upwardly converging surfaces 7 of baffles 5. The oxygen escapes from the uppermost ends of the upwardly converging surfaces 7 enhancing dissolution of the alumina fed over the downwardly converging surfaces 6.

Figures 10, 11, 12:
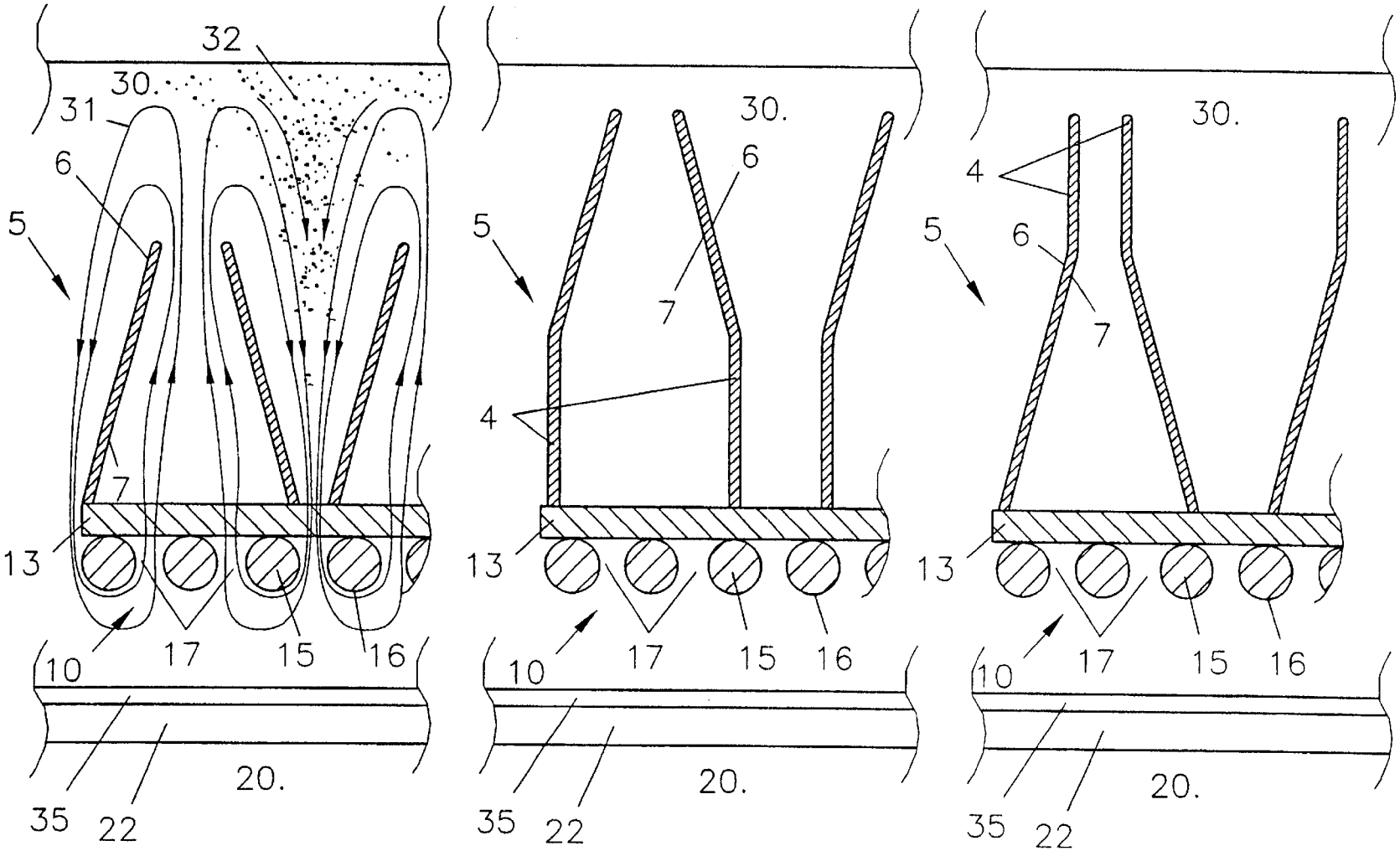
FIGS. 10, 11 and 12 are enlarged views of parts of variations of the electrolyte guide members shown in FIG. 9, FIG. 10 illustrating cell operation.

The aluminium electrowinning cells partly shown in FIGS. 10, 11 and 12 are similar to the aluminium electrowinning cell shown in FIG. 9.

In FIG. 10 the guide members are inclined baffles 5 as shown in FIG. 9. In this example the uppermost end of each baffle 5 is located just above mid-height between the surface of the electrolyte 30 and the transverse connecting members 13.

Also shown in FIG. 10, an electrolyte circulation 31 is generated by the escape of gas released from the active surfaces 16 of the anode members 15 between the inter-member gaps 17 and which is deflected by the upward converging surfaces 7 of the baffles 5 confining the gas and the electrolyte flow between their uppermost edges. From the uppermost edges of the baffles 5, the anodically evolved gas escapes towards the surface of the electrolyte 30, whereas the electrolyte circulation 31 flows down through the downward converging surfaces 6, through the inter-member gaps and around edges of the metallic anode structure 12,13,15 to compensate the depression created by the anodically released gas below the active surfaces 17 of the anode members 15. The electrolyte circulation 31 draws down into the inter-electrode gap dissolving alumina particles 32 which are fed above the downward converging surfaces 6.

FIG. 11 shows part of an aluminium electrowinning cell with baffles 5 operating as electrolyte guide members like those shown in cell of FIG. 9 but whose surfaces are only partly converging. The lower sections 4 of the baffles 5 are vertical and parallel to one another, whereas their upper sections have upward and downward converging surfaces 6,7. The uppermost end of the baffles 5 are located below but close to the surface of the electrolyte 30 to increase the turbulence at the electrolyte surface caused by the release of anodically evolved gas.

FIG. 12 shows a variation of the baffles shown in FIG. 11, wherein parallel vertical sections 4 are located above the converging surfaces 6,7.

By guiding and confining anodically-evolved oxygen towards the surface of the electrolyte 30 with baffles or other confinement means as shown in FIGS. 11 and 12 and as further described in concurrently filed application PCT/IB99/00017 (de Nora), oxygen is released so close to the surface as to create turbulences above the downwardly converging surfaces 6, promoting dissolution of alumina fed thereabove.

It is understood that the electrolyte confinement members 5 shown in FIGS. 9, 10, 11 and 12 can either be elongated baffles, or instead consist of a series of vertical chimneys of funnels of circular or polygonal cross-section, for instance as described below.

Figure 13:
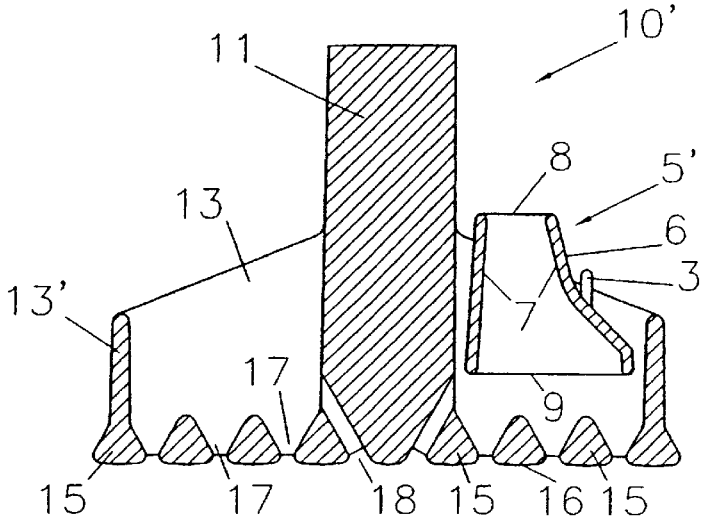
FIG. 13 is a cross section of another anode according to the invention with electrolyte guide members only one of which is shown.
Figure 14:
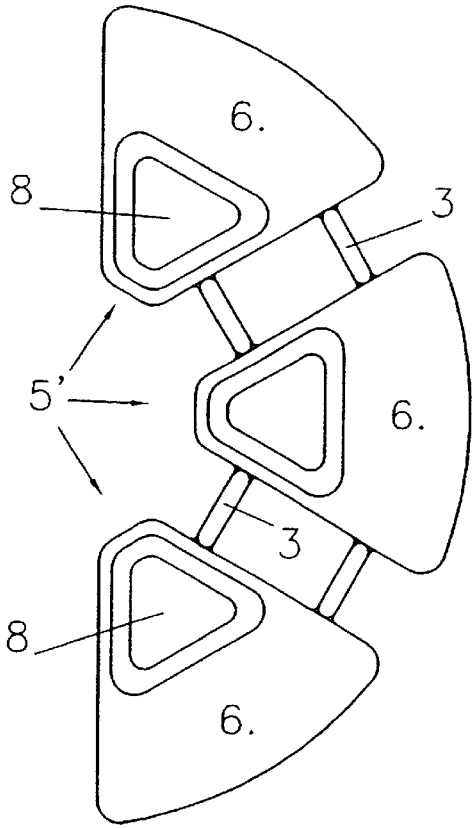
FIG. 14 shows a plan view of half of an assembly of several electrolyte guide members like the one shown in FIG. 13.
Figure 15:
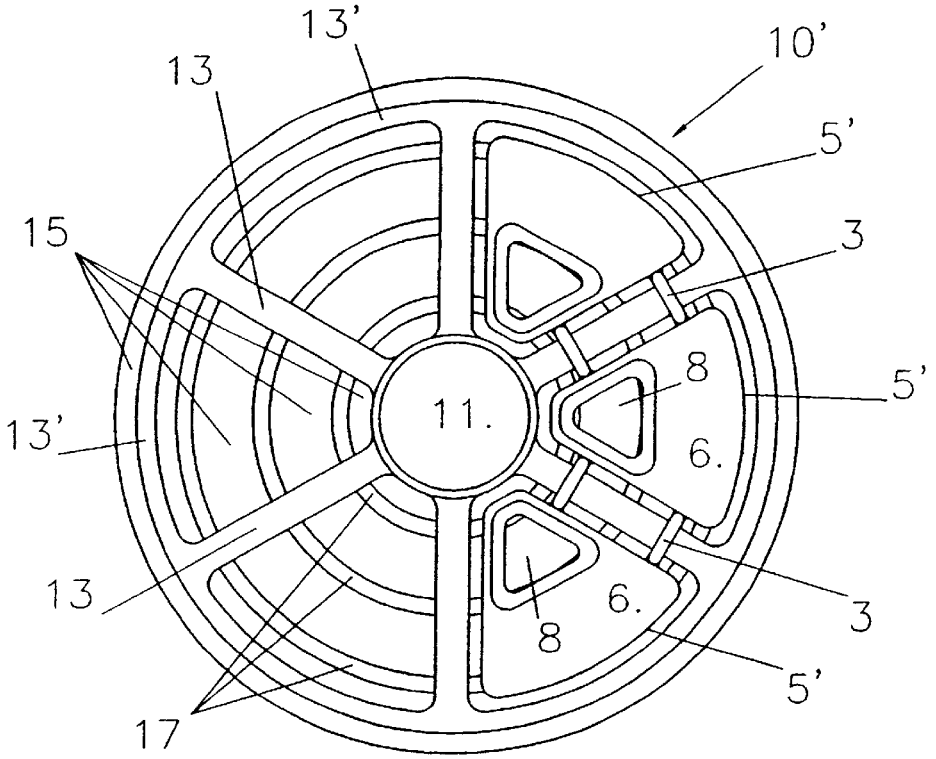
FIG. 15 is a plan view of the anode shown FIG. 13 with half of an assembly of electrolyte guide members as shown in FIG. 14.

FIGS. 13 and 15 illustrate an anode 10' having a circular bottom, the anode 10' being shown in cross-section in FIG. 5 and from above in FIG. 15. On the right hand side of FIGS. 13 and 15 the anode 10' is shown with electrolyte guide members 5' according to the invention. The electrolyte guide members 5' represented in FIG. 15 are shown separately in FIG. 14.

The anode 10' shown in FIGS. 13 and 15 has several concentric circular anode members 15. The anode members 15 are laterally spaced apart from one another by inter-member gaps 17 and connected together by radial connecting members in the form of flanges 13 which join an outer ring 13'. The outer ring 13' extends vertically from the outermost anode members 15, as shown in FIG. 13, to form with the radial flanges 13 a wheel-like structure 13,13', shown in FIG. 15, which secures the anode members 15 to a central anode current feeder 11.

As shown in FIG. 13, the innermost circular anode member 15 partly merges with the current feeder 11, with ducts 18 extending between the innermost circular anode member 15 and the current feeder 11 to permit the escape of oxygen produced underneath the central current feeder 11.

Each electrolyte guide member 5' is in the general shape of a funnel having a wide bottom opening 9 for receiving anodically produced oxygen and a narrow top opening 8 where the oxygen is released to promote dissolution of alumina fed above the electrolyte guide member 5'. The inner surface 7 of the electrolyte guide member 5' is arranged to canalise and promote an upward electrolyte flow driven by anodically produced oxygen. The outer surface 6 of the electrolyte guide member 5' is arranged to promote dissolution of alumina fed thereabove and guide alumina-rich electrolyte down to the inter-electrode gap, the electrolyte flowing mainly around the foraminate structure.

As shown in FIGS. 14 and 15, the electrolyte guide members 5' are in a circular arrangement, only half of the arrangement being shown. The electrolyte guide members 5' are laterally secured to one another by attachments 3 and so arranged to be held above the anode members 15, the attachments 3 being for example placed on the flanges 13 as shown in FIG. 15 or secured as required. Each electrolyte guide member 5' is positioned in a circular sector defined by two neighbouring radial flanges 13 and an arc of the outer ring 13' as shown in FIG. 15.

The arrangement of the electrolyte guide members 5' and the anode 10' can be moulded as units. This offers the advantage of avoiding mechanical joints and the risk of altering the properties of the materials of the electrolyte guide members 5' or the anode 10' by welding.

The anodes 10' and electrolyte guide members 5' can be made of any suitable material resisting oxidation and the fluoride-containing molten electrolyte, for example as disclosed in PCT/IB99/01360 (Duruz/de Nora/Crottaz), PCT/IB99/00015 (de Nora/Duruz), PCT/IB99/01361 (Duruz/de Nora/Crottaz), PCT/IB99/01362 (Crottaz/Duruz), PCT/IB99/01977 (de Nora/Duruz) and PCT/IB99/01976 (Duruz/de Nora).

Figure 16:
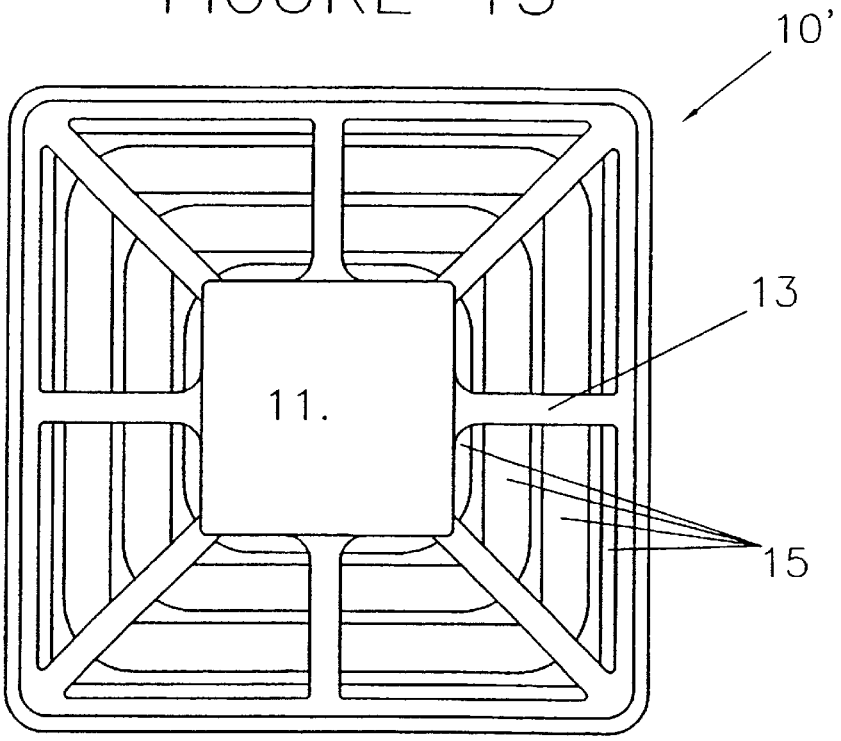
FIG. 16 is a plan view of a variation of the anode of FIG. 15.

FIG. 16 illustrates a square anode 10' as a variation of the round anode 10' of FIGS. 13 and 15. The anode 10' of FIG. 16 has generally rectangular concentric parallel anode members 15 with rounded corners. The anode 10' shown in FIG. 16 can be fitted with electrolyte guide members similar to those of FIGS. 13 to 15 but in a corresponding rectangular arrangement.

What is claimed is:

1. A cell for the electrowinning of aluminium from alumina dissolved in a fluoride-containing molten electrolyte, comprising at least one non-carbon metal-based anode having an electrically conductive metallic structure with an electrochemically active anode surface on which, during electrolysis, oxygen is anodically evolved, the metallic structure being suspended in the electrolyte with its active anode surface substantially parallel to a facing planar cathode surface, said metallic structure comprising a series of horizontally elongated anode members, each anode member having a length that is much greater than its thickness, the anode members being arranged parallel to one another, spaced apart from one another transversally in a generally coplanar arrangement, each anode member having an electrochemically active surface, the electrochemically active surfaces of the anode members forming said active anode surface that extends over an expanse whose dimensions are much greater than the thickness of the elongated anode members, the spaced apart anode members forming horizontally elongated flow-through openings for the circulation of electrolyte driven by the fast escape of anodically evolved oxygen.

2. The cell of claim 1, wherein one or more flow-through openings of the or each anode structure is arranged for the flow of alumina-depleted electrolyte away from an electrolysis zone between the anode(s) and the cathode.

3. The cell of claim 2, wherein part of the electrolyte circulates around the or each metallic anode structure.

4. The cell of claim 1, wherein one or more flow-through openings of the or each anode structure is arranged for the flow of alumina-rich electrolyte to an electrolysis zone between the anode(s) and the cathode.

5. The cell of claim 1, wherein the active anode surface is substantially horizontal.

6. The cell of claim 1, wherein the active anode surface is substantially vertical.

7. The cell of claim 1, wherein the active anode surface is inclined to the horizontal.

8. The cell of claim 1, wherein the anode members are spaced-apart blades.

9. The cell of claim 1, wherein the anode members are spaced-apart bars, rods or wires.

10. The cell of claim 9, wherein said bars, rods or wires have a generally circular cross-section.

11. The cell of claim 9, wherein said bars, rods or wires have in cross-section an upper generally semi-circular part and a flat bottom.

12. The cell of claim 9, wherein said bars, rods or wires have a generally rectangular cross-section.

13. The cell of claim 9, wherein said bars, rods or wires have a generally bell-shape or pear-shape cross-section.

14. The cell of claim 1, wherein the anode members are spaced-apart blades, bars, rods or wires which are generally rectilinear.

15. The cell of claim 1, wherein the anode members are spaced-apart blades, bars, rods or wires which are in a generally concentric arrangement, each blade, bar, rod or wire forming a loop.

16. The cell of claim 15, wherein each blade, bar, rod or wire is generally circular, oval or polygonal.

17. The cell of claim 1, wherein each anode member comprises an electrically conductive first support member supporting at least one electrochemically active second member, the surface of the second member forming the electrochemically active surface.

18. The cell of claim 17, wherein said first member supports a plurality of second members spaced apart to allow for different thermal expansion.

19. The cell of claim 17, wherein said second member is electrically and mechanically connected to said first member by an intermediate connecting member.

20. The cell of claim 1, wherein the anode members are connected to one another by one or more transverse connecting members.

21. The cell of claim 20, wherein the anode members are transversally connected by a plurality of transverse connecting members which are in turn connected together by one or more cross members.

22. The cell of claim 20, wherein the or each anode comprises a vertical current feeder arranged to be connected to a positive bus bar which is mechanically and electrically connected to one or more transverse connecting members or to at least one cross member connecting a plurality of transverse connecting members, for carrying electric current to the anode members through the transverse connecting member(s) and, where present, through the cross member(s).

23. The anode of claim 22, wherein the vertical current feeder, anode members, transverse connecting member(s) and, where present, cross member(s) are secured together as a unit.

24. The cell of claim 1, wherein at least the active anode surface of the or each anode is coated with an oxygen-evolving coating.

25. The cell of claim 24, wherein said electrochemically active anode surface is made of a metal.

26. The cell of claim 24, wherein said electrochemically active anode surface is made of an iron oxide.

27. The cell of claim 1, wherein the cathode is aluminium-wettable.

28. The cell of claim 27, wherein cathode is in a drained configuration.

29. The cell of claim 1, comprising means to facilitate dissolution of alumina fed into the electrolyte.

30. The cell of claim 1, having means to thermally insulate the surface of the electrolyte to prevent the formation of an electrolyte crust on the electrolyte surface.

31. A method of producing aluminium in a cell as defined in claim 1, comprising passing an electric current through the anode members of the or each anode as electronic current and therefrom through the electrolyte to the cathode as ionic current, thereby producing aluminium on the cathode and oxygen on the electrochemically active anode surface whose escape induces an electrolyte circulation through said flow-through openings.

32. The method of claim 31, comprising maintaining in the electrolyte a sufficient amount of dissolved alumina and one or more anode constituents to keep the anode(s) dimensionally stable by preventing dissolution thereof into the electrolyte.

33. The method of claim 31, wherein the cell is operated at a sufficiently low temperature to limit the solubility of anode constituents in the electrolyte thereby limiting the contamination of the product aluminium by cathodically reduced anode constituent(s) to an commercially acceptable level.

34. A non-carbon metal-based anode of a cell for the electrowinning of aluminium as defined in claim 1, comprising an electrically conductive metallic structure with an electrochemically active anode surface resistant to oxidation and fluoride-containing molten electrolyte, on which, during electrolysis, oxygen is anodically evolved, the metallic structure being suspended in the electrolyte with its active anode surface substantially parallel to a facing planar cathode surface, said metallic structure comprising a series of horizontally elongated anode members, each anode member having a length chat is much greater than its thickness, the anode members being arranged parallel to one another, spaced apart from one another transversally in a generally coplanar arrangement, each anode member having an electrochemically active surface, the electrochemically active surfaces of the anode members forming said active anode surface that extends over an expanse whose dimensions are much greater than the thickness of the elongated anode members, the spaced apart anode members forming horizontally elongated flow-through openings for the circulation of electrolyte driven by the fast escape of anodically evolved oxygen.

35. The anode of claim 34, wherein the anode members are spaced apart blades, bars, rods or wires.

36. The anode claim 35, wherein the anode members are generally rectilinear.

37. The anode of claim 35, wherein the anode members are in a generally concentric arrangement, each anode member forming a loop.

38. The anode of claim 37, wherein each anode member is generally circular, oval or polygonal.

* * * * *